US005685409A

United States Patent [19]

Bruss et al.

[11] Patent Number: 5,685,409

[45] Date of Patent: Nov. 11, 1997

[54] APPARATUS FOR REMOVING BOBBIN TUBES PERPENDICULARLY FROM CARRIERS ON A BOBBIN CONVEYOR

[75] Inventors: Karl-Heinz Bruss; Clemens Offergeld, both of Mönchengladbach; Fernando Guerreiro, Heinsberg, all of Germany

[73] Assignee: W. Schlafhorst AG & Co., Moenchengladbach, Germany

[21] Appl. No.: 574,725

[22] Filed: Dec. 19, 1995

[30] Foreign Application Priority Data

Dec. 23, 1994 [DE] Germany ..... 44 46 161.5

[51] Int. Cl.[6] ..... B65G 47/26

[52] U.S. Cl. ..... 198/457; 198/624

[58] Field of Search ..... 198/457, 598, 198/599, 604, 608, 624, 465.1; 242/355 A

[56] References Cited

U.S. PATENT DOCUMENTS

| | | | |
|---|---|---|---|
| 4,651,865 | 3/1987 | Küpper et al. | 198/598 X |
| 4,674,636 | 6/1987 | Sekitani et al. | 209/600 |
| 5,118,958 | 6/1992 | Noshi et al. | 250/571 |
| 5,277,295 | 1/1994 | Grechsch et al. | 198/457 |
| 5,366,065 | 11/1994 | Gsecksch et al. | 198/624 X |

FOREIGN PATENT DOCUMENTS

| | | |
|---|---|---|
| 34 07 804 A1 | 9/1984 | Germany . |
| 35 35 219 A1 | 4/1986 | Germany . |
| 40 08 795 A1 | 9/1990 | Germany . |
| 40 24 787 C1 | 10/1991 | Germany . |
| 40 38 628 A1 | 6/1992 | Germany . |
| 41 42 620 A1 | 6/1993 | Germany . |
| OS 49 26531 | 7/1972 | Japan . |
| 3-174030 A | 7/1991 | Japan . |
| PS 424 568 | 6/1964 | Switzerland . |

*Primary Examiner*—James R. Bidwell

*Attorney, Agent, or Firm*—Kennedy Covington Lobdell & Hickman, LLP

[57] ABSTRACT

An apparatus is disclosed for removing bobbin tubes axially from individual tube carriers conveyed along a conveying path. The bobbin removing apparatus basically comprises a pair of bobbin withdrawal devices located at opposite lateral sides of the conveying path for frictionally engaging the bobbin tubes therebetween to thereby draw the bobbin tubes off the respective carriers while they are continuously conveyed along the conveying path. According to the invention, one or both of the withdrawal devices comprises a freely rotatable disk having an annular periphery of a high coefficient of friction arranged for peripheral engagement with the bobbin tubes conveyed along the conveying path to be rotated by engagement with each bobbin conveyed past the disk. The disk or disks are arranged to engage the bobbin tubes at an acute angle with respect to the conveying path of the individual carriers on which the tubes are supported.

14 Claims, 6 Drawing Sheets

APPARATUS FOR REMOVING BOBBIN TUBES PERPENDICULARLY FROM CARRIERS ON A BOBBIN CONVEYOR

FIELD OF THE INVENTION

The present invention relates to an apparatus disposed along a bobbin tube conveyor for removing bobbin tubes perpendicularly from individual carriers, and relates more particularly to such an apparatus having opposing members for grasping the bobbins frictionally therebetween to draw them off their carriers, wherein the bobbin grasping members are operative to withdraw the bobbins at an acute angle to the direction of conveyance of the individual carriers while the carriers are being continuously transported by the conveyor.

BACKGROUND OF THE INVENTION

In bobbin winding machines, empty bobbin tubes which have been unwound from yarn cops supported on arbors must be pulled off the arbors in all cases in which the tubes are not placed onto peg trays or other suitable carriers to be transported to a spinning frame. Various apparatus have been proposed for this purpose.

Bobbin withdrawal apparatus operating with bobbin grippers have been widely used (see German Patent Publication DE 34 07 804 A1, for example). Such apparatus are relatively complicated and do not permit a large throughput rate, since they operate discontinuously.

The throughput rate of such bobbin withdrawal apparatus can be improved, for example, by provision of a plurality of grippers. As described, for example, in Swiss Patent CH-PS 424 568, the grippers are moved over a defined section of the bobbin conveyance path synchronously with the arbors of the cops at a spinning frame. Such an arrangement is also relatively elaborate and is also tied to a tight and correct division in the arrangement of the cops, such as occurs inside a spinning frame at the spinning spindles.

Bobbin withdrawal apparatus which draw off the cops or bobbins by frictional engagement are known from Japanese OS 49-26531 and German Patent Publication DE 35 35 219 A1. However, both apparatus are only suitable for discontinuous use, i.e. the cops or bobbins must be stopped at a position in which they are in contact with the apparatus. The apparatus of German Patent Publication DE 35 35 219 A1 in addition requires actuating devices for activating the bobbin withdrawal means in coordination with the supply of the bobbins to be withdrawn.

German Patent Publication DE 40 38 628 A1 discloses an apparatus which permits continuous operation and also does not require timing of the withdrawal means, the design of which is already simplified in comparison with previous solutions.

OBJECTS AND SUMMARY OF THE INVENTION

It is accordingly an object of the instant invention to further develop and improve the bobbin withdrawal apparatus in accordance with the aforementioned German Patent Publication DE 40 38 628 A1 in such a way that its design is further simplified.

Briefly summarized, the present invention accomplishes the foregoing objective by providing an apparatus for removing bobbin tubes axially from individual tube carriers conveyed along a conveying path, wherein the bobbin removing apparatus basically comprises a pair of bobbin withdrawal devices located at opposite lateral sides of the conveying path for frictionally grasping the bobbin tubes therebetween to thereby draw the bobbin tubes off the respective carriers while they are continuously conveyed along the conveying path. According to the invention, one or both of the withdrawal devices comprises a freely rotatable disk having an annular periphery of a high coefficient of friction arranged for peripheral engagement with the bobbin tubes conveyed along the conveying path to be rotated by engagement with each bobbin conveyed past the disk. The disk or disks are arranged to engage the bobbin tubes at an acute angle with respect to the conveying path of the individual carriers on which the tubes are supported. It is preferred that each disk comprise an annular periphery of a high coefficient of friction arranged for peripheral engagement with the bobbin tubes conveyed along the conveying path.

The advantages of continuous operation, i.e., without stopping and positioning the bobbins in the area of the withdrawal apparatus and without the requirement of timing the withdrawal devices as a function of the supply of the bobbins, are maintained in the present invention. The design of the apparatus in accordance with the invention is clearly simplified in comparison with the apparatus of German Patent Publication DE 40 38 628 A1. The requirement of a separate drive for the withdrawal devices or means in particular is generally unnecessary. Instead, the withdrawal devices are automatically engaged and driven by means of the bobbins themselves as they are being conveyed past the withdrawal devices. As a result, a withdrawal movement corresponding to the course of the movement of the bobbins is automatically assured. As a whole, this results in an apparatus which has an extremely low susceptibility to problems because of its uncomplicated design.

A number of possible embodiments are contemplated. In certain embodiments, a resilient support or other means may be provided for biasing one or both disks toward the conveying path. As an alternative, the annular periphery of one or both disks may comprise an elastically deformable material disposed relative to the conveying path to be deformed when contacting bobbin tubes conveyed along the conveying path.

In embodiments utilizing a pair of opposed disks, the axis of rotation of one disk may be disposed at an offset in respect to the axis of rotation of the other disk along the conveying path of the bobbin tubes. In other embodiments, a single disk may comprise one withdrawal device while the other withdrawal device comprises a pressure element having a bobbin tube engaging surface of a low coefficient of friction to promote sliding of the bobbin tubes therealong.

It is also contemplated that two pairs of the disks or other withdrawal devices may be utilized. In one embodiment, two disk pairs are arranged at a spacing to one another along the conveying path. In another embodiment, two pairs of the disks are disposed adjacent the conveying path at a spacing from one another axially relative the longitudinal of the bobbins.

Preferably, the conveying path at the withdrawal devices is oriented to dispose the bobbins being conveyed thereat in an essentially horizontal disposition. Thus, a bobbin collecting apparatus may be disposed underneath the withdrawal devices. The conveying apparatus may comprise elements spaced along the conveying path for interlocking contact with the individual carriers. Alternatively, the conveying apparatus may be arranged for frictional contact with the individual carriers and, at least at the withdrawal devices, preferably comprises means for applying an additional force urging frictional contact with the individual carriers.

In order to insure that the section of the bobbin conveyor at which the bobbin tubes are to be withdrawn and at which the disks or other grasping members of the withdrawal devices are in contact with each other is of an appropriate length, the gap width between the disks or other tube grasping members must change during the withdrawal process. This can either be achieved by mounting one or more of the disks or other grasping members resiliently, or the disks may consist at least partially of a material which is highly elastically deformable. In either of the two variations mentioned, the two disks or other grasping members may be offset with respect to each other in the conveying direction.

If two disks are used as opposed grasping members, the withdrawal force may be increased if both disks have an annular periphery with a high coefficient of friction. If, however, the second grasping member is a non-rotatable pressure element instead of a disk, its surface must have a low coefficient of friction which permits sliding of the bobbin tubes.

Particularly in cases where the bobbin tubes have been placed on relatively long arbors or are intended to be put down in order, it can be advantageous to dispose two pairs of disks or other form of grasping or withdrawal means behind each other. Such an apparatus is also clearly simpler in design than known withdrawal apparatus.

Alternatively or additionally to the arrangement in pairs of disks or other grasping or withdrawal means behind each other in relation to the bobbin conveying path, it is also possible to dispose disks or other withdrawal means in pairs in the direction of the bobbin axis which increases the localized withdrawal force. Such an apparatus is therefore particularly suited for bobbin tubes which adhere relatively strongly to the arbor, which is especially the case if the arbor has elastic elements on its exterior which are inserted into the bobbin tube interior.

The withdrawal of bobbin tubes is simplified if the withdrawal apparatus is arranged on a portion of the conveying path in which the bobbin tubes assume a horizontal conveying position. The withdrawn bobbin tubes can then be deposited directly into a collecting apparatus disposed underneath the withdrawal apparatus.

Since the withdrawal apparatus is driven by the bobbin tubes themselves, it is necessary to impose a sufficiently large conveying force on the bobbin tubes along their conveying path. This can be achieved by arranging the carriers on whose arbors the bobbin tubes are placed to be carried along in an interlocked manner by the conveying means. Alternatively, in case the carriers are conveyed by means of a frictional connection with the conveyor, the frictional connection may be increased at least locally in the area of the withdrawal devices.

The invention will be explained in detail below by means of exemplary embodiments, making reference to the attached drawings.

DETAILED DESCRIPTION OF THE PREFERRED EMBODIMENTS

Figure 1:
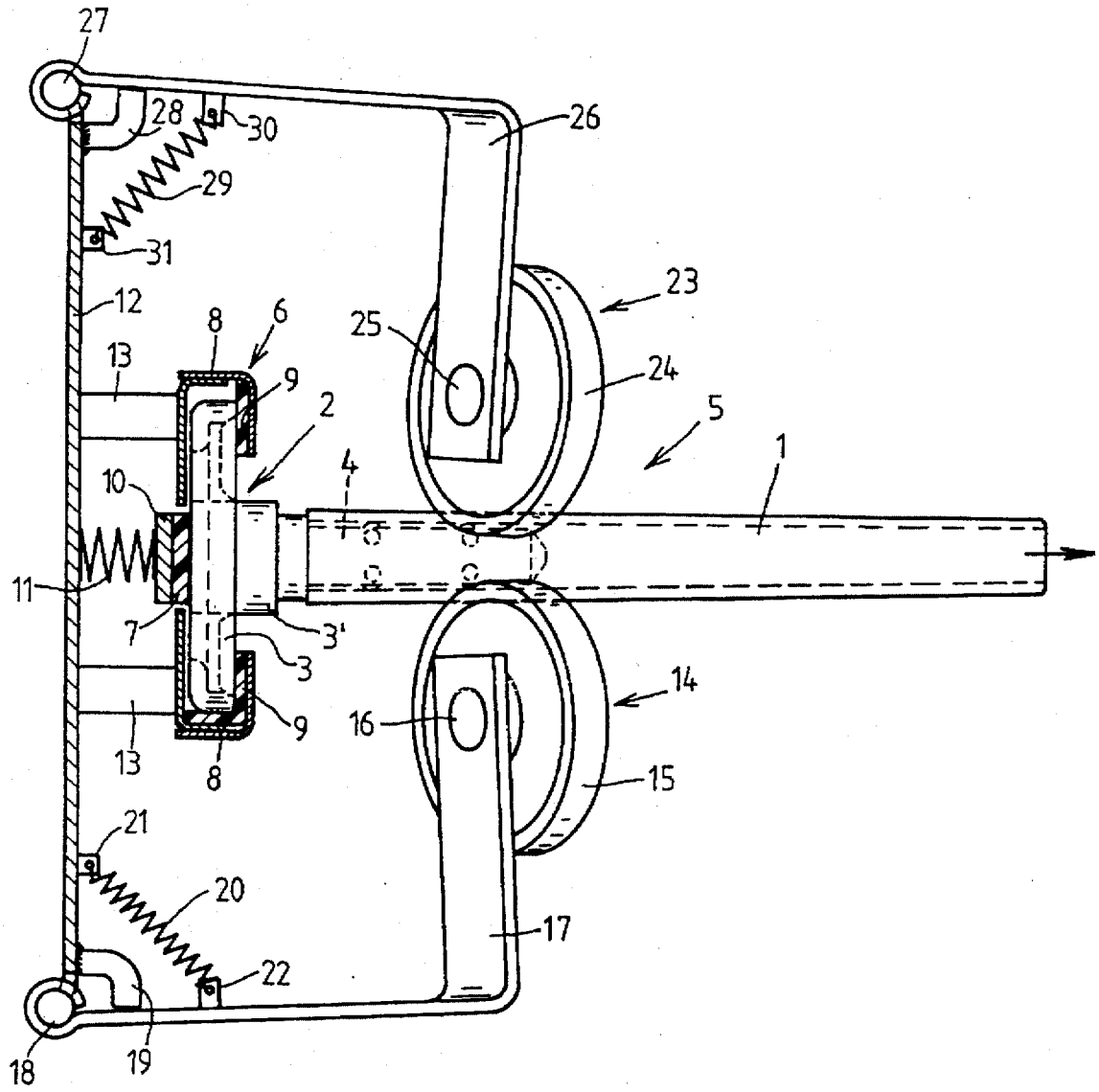
FIG. 1 is an end elevational view of the bobbin withdrawal apparatus in accordance with a preferred embodiment of the present invention, with the associated conveying arrangement for the individual bobbin carriers being shown in section.

Initially it should be pointed out that in all drawing figures the conveying paths of the individual bobbin carriers 2 are arranged such that the bobbins 1 placed on the arbors 4 of the carriers 2 are in a horizontal disposition, at which it is preferred under the present invention that the bobbin withdrawal apparatus be located along the bobbin conveying path. Such an arrangement of the withdrawal apparatus on the horizontal conveying section of a so-called cop bridge, which bridges a service platform between adjoining machines, has proven to be especially advantageous. In this manner, the bobbins 1 can be deposited directly into a collection apparatus disposed underneath the withdrawal apparatus. However, it should also be pointed out that the invention is not limited to this particular arrangement of the conveying section.

In each embodiment, the individual carriers 2 are transported by means of a conveyor belt 7 along a conveying path 6 defined by a channel assembly 8 which guides the individual carriers 2 in the conveying direction.

The channel assembly 8, at least in the area of the withdrawal apparatus 5, is fitted interiorly with an angled plastic element 9 and a straight plastic element 9' which are intended to prevent wear of the conveying conduit 8 in the area of the withdrawal apparatus 5. Advantageously, the elements 9 and 9' are also appropriately interchangeable and have a high degree of sliding ability. The straight plastic element 9' and one leg portion of the angled plastic element 9 are aligned coplanarly with one another for contact with the tops of the base plates 3 of the individual carriers 2 and therefore are particularly exposed to wear because, when pulling a bobbin off its associated carrier 2, the top of the carrier base plate 3 is drawn against one or both of these plastic elements 9, 9' as the individual carrier 2 continues to be simultaneously conveyed.

The channel assembly 8 is open along its length between the elements 9, 9' at the top, or outward, side of the channel assembly 8 facing the bobbin 1. A foot 3' of each individual carrier 2 projects out of the base plate 3 and can pass through this opening as the carrier 2 travels along the conduit 8.

The channel assembly 8 is mounted in a vertical orientation on horizontal supports 13 extending along the channel assembly 8. A conveyor belt 7 is supported along the length of the conveying path 6, including the area of the withdrawal apparatus, by a pressure plate 10 engaging the underside of the conveyor belt 7 in order to promote sufficient contact by the conveyor belt 7 with the underside of the base plates 3 of the individual carriers 2 that a sufficient frictional force can be exerted on the individual carriers 2 to be transported by the conveyor belt 7. Notably, this frictional conveying force must be greater in the area of the withdrawal apparatus and, for such reason, the pressure plate 10 is urged by a pressure spring 11 in the area of the withdrawal apparatus to locally increase the pressing force of the conveyor belt 7 against the carrier base plates 3. Alternatively, this pressure plate 10 can be replaced by pressure rollers which also may be urged against the underside of the conveyor belt by a spring force. Advantageously, this arrangement enables the frictional force between the pressure rollers and the conveyor belt 7 to be reduced over the use of a pressure plate 10. However, normally good results can be achieved utilizing a pressure plate 10 if the surface of the pressure plate 10 coming into contact with the conveyor belt 7 is sufficiently smooth.

In the particular embodiment represented in FIG. 1, the withdrawal apparatus 5 comprises a pair of freely rotatable disks 14, 23 arranged in opposition to one another laterally outwardly of the channel assembly 6 to define a gap between the disks 14, 23. A bobbin 1 is shown carried on an arbor 4 extending outwardly through the forward opening in the channel assembly 6 from a carrier 2 being transported by the conveyor 7 within the channel assembly 6. As illustrated, the carrier 2 and its supported bobbin 1 have not yet reached the gap between the disks 14, 23 of the withdrawal apparatus 5. Therefore, the bobbin 1 is still completely seated on the arbor 4 of the individual carrier 2. It can also be clearly seen that the narrowest dimension of the gap between the rotatable disks 14, 23 is clearly less than the exterior diameter of the bobbin 1 in the area in which it will come into contact with the rotatable disks 14, 23.

Each of the rotatable disks 14, 23 has a frictional coating 15, 24 which results in a quite strong gripping adhesion to the bobbin surface during contact with the bobbin 1. The rotatable disks 14, 23 are supported to be freely rotatable on shafts 16, 25 fastened in angled sheet metal arms 17, 26 which, in turn, are pivotable about pivot shafts 18, 27 fastened on the machine frame 12. The angled sheet metal arms 17, 18 are urged pivotably against stops 19, 28 by means of tension springs 20, 29. These stops 19, 28 define the final narrowest dimension of the gap between the rotatable disks 14, 23. The tension springs 20, 29 are suspended between respective holder pairs 21, 22 and 30, 31 on the machine frame 12 and on the adjoining angled arms 17, 26.

The shafts 16, 25 are inclined relative to one another by means of an appropriate configuration of the angled sheet metal arms 17, 26, so that the respective circumferential peripheries of the rotatable disks 14, 23 define a bobbin conveying direction oriented at an acute angle with the conveying direction of the individual carriers along the conveyor belt 7. Therefore, as a bobbin is moved in the normal course of its conveying movement in the direction of the conveying path 6, the bobbin 1 enters the gap between the rotatable disks 14, 23 and the rotatable disks 14, 23 are thereby caused to be rotated because of the adhesion of the frictional coatings 15, 24 relative to the surface of the bobbin 1. The inclined arrangement of the disks 14, 23 imposes an additional component of movement on the bobbin 1 in the direction of its longitudinal axis simultaneously as it is being conveyed through the withdrawal apparatus 5.

The rotatable disks 14, 23 can be deflected outwardly by pivotal movement of the angled sheet metal arms 17, 26 about their pivot shafts 18, 27. However, because of the force of the tension springs 20, 29, the disks 14, 23 are increasingly pressed against the bobbin 1 to be drawn off the arbor 4. The force component increases very rapidly in the direction of the longitudinal axis of the bobbin 1 as the bobbin 1 approaches the narrowest dimension of the gap between the rotatable disks 14,23, leading to a spontaneous impression of an axial withdrawal force on the bobbin 1. In this manner, it is surprisingly possible to draw the bobbin 1 off the arbor 4 over a short distance and without interruption of the conveying movement of the individual carriers 2 by the conveyor 7.

After passage through the narrowest portion of the gap between the rotatable disks 14, 23, the clamping force by the disks 14, 23 on the bobbin 1 is decreased, but is still strong enough to continue to drawn the bobbin 1, once accelerated, further in the direction of its longitudinal axis. The tension springs 20, 29 insure that the frictional coatings 15, 24 of the disks 14, 23 are still engaged against the bobbin surface as the bobbin 1 passes beyond the narrowest portion of the disk gap.

Although the extent of movement of a given point on the frictional coatings 15, 24 of the disks 14, 23 during the course of such contact with the surface of a bobbin 1 in the direction of the longitudinal axis of the bobbin 1 is clearly less than the total length of the arbor 4, the complete withdrawal of a bobbin 1 from its arbor 4 is possible by means of this apparatus. This surprisingly effect can only be explained to occur in that, from the initial entry of the bobbin 1 into the withdrawal apparatus 5 until the maximum clamping force has been attained at the narrowest portion of the gap between the disks 14, 23, the bobbin 1 has been accelerated outwardly in its axial direction to such a degree that it continues withdrawal movement axially outwardly from the arbor 4 even after passing the narrowest clamping point.

Figure 2:
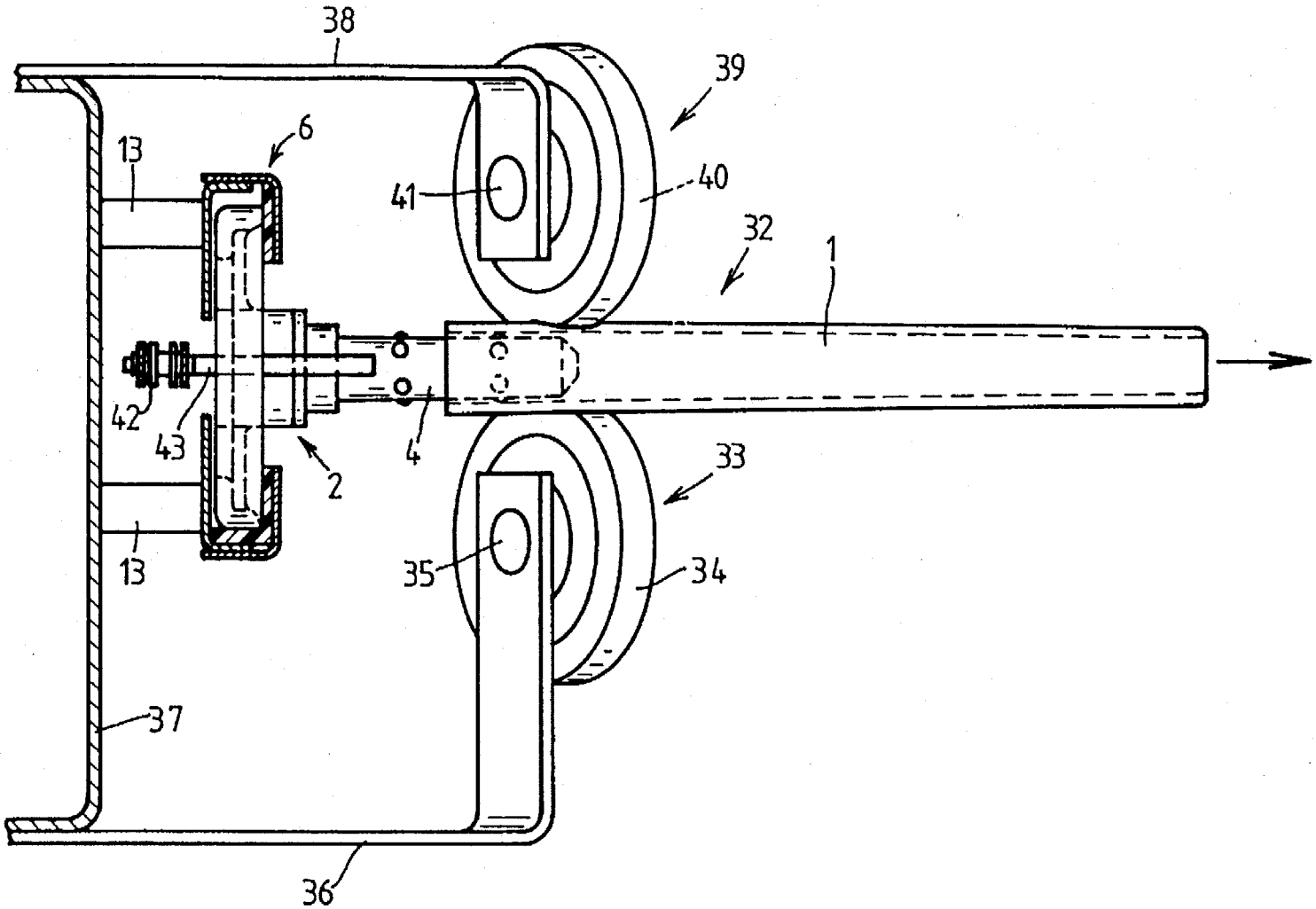
FIG. 2 is another end view partially in elevation and partially in section, similar to FIG. 1, depicting an alternative embodiment of the bobbin withdrawal apparatus of the present invention.

In a variant of the invention represented in FIG. 2, the bobbin withdrawal apparatus 32 has two disks 33, 39 supported at a spacing from one another on angled sheet metal arms 36, 38 for rotation about shafts 35, 41 outwardly of the channel assembly 6. Each disk 33, 39 has a relatively thick elastic frictional circumferential coating 34, 40. Thus, when a bobbin 1 is conveyed through the spacing between the disks 33, 39, the elastic friction coatings 34, 40 yield sufficiently that it is unnecessary to spring-mount the angled sheet metal arms 36, 38 which support the rotatable disks 33, 39 and, in turn, the angled sheet metal arms 36, 38 may be fixed in place on the machine frame 37. As a result, a clamping force and thus an axial withdrawal effect, in the manner as described above with regard to the embodiment of FIG. 1, is imposed on the bobbin 1 over a sufficient lengthwise section of the conveying path of the individual carriers 2 and bobbins 1. However, to still lengthen this withdrawal section, the two rotatable disks 33, 39 are slightly offset in respect to each other in the conveying direction of the bobbins 1 and individual carriers 2.

Thus, it can be clearly seen in FIG. 2 that the bobbin 1 is depicted as having already passed the rotatable disk 33 while still being in contact with the elastic friction coating 40 of the rotatable disk 39. In this case the bobbin 1 has already been withdrawn axially over more than half the displacement path from the arbor 4 and has already been sufficiently accelerated in such withdrawal direction that the remaining withdrawal movement imposed by the disk 39 is sufficient to remove the bobbin 1 completely from the arbor 4. However, care should be taken that the two rotatable disks 33 and 39 are not offset too greatly along the conveying path of the bobbins 1, in order to insure that an area is provided between the disks 33, 39 in which each succeeding bobbin 1 will be in contact with the elastic frictional coatings 34, 40 of both disks which is required for achieving the described axial acceleration of the bobbin 1.

As an further alternative to the embodiment of FIG. 1, the conveyance of the individual carriers along the conveying path 6 takes place here in an interlocking manner by means of a chain 42 moving along the conveying path 6 with dogs 43 placed along the chain 42 at selected spacings for the individual carriers 2 to be transported. The dogs 43 engage openings, described more fully hereinbelow in connection with FIG. 6, in the base plates 3 of the individual carriers 2 to form an essentially interlocked connection between each carrier 2 and the chain 42.

Figure 3:
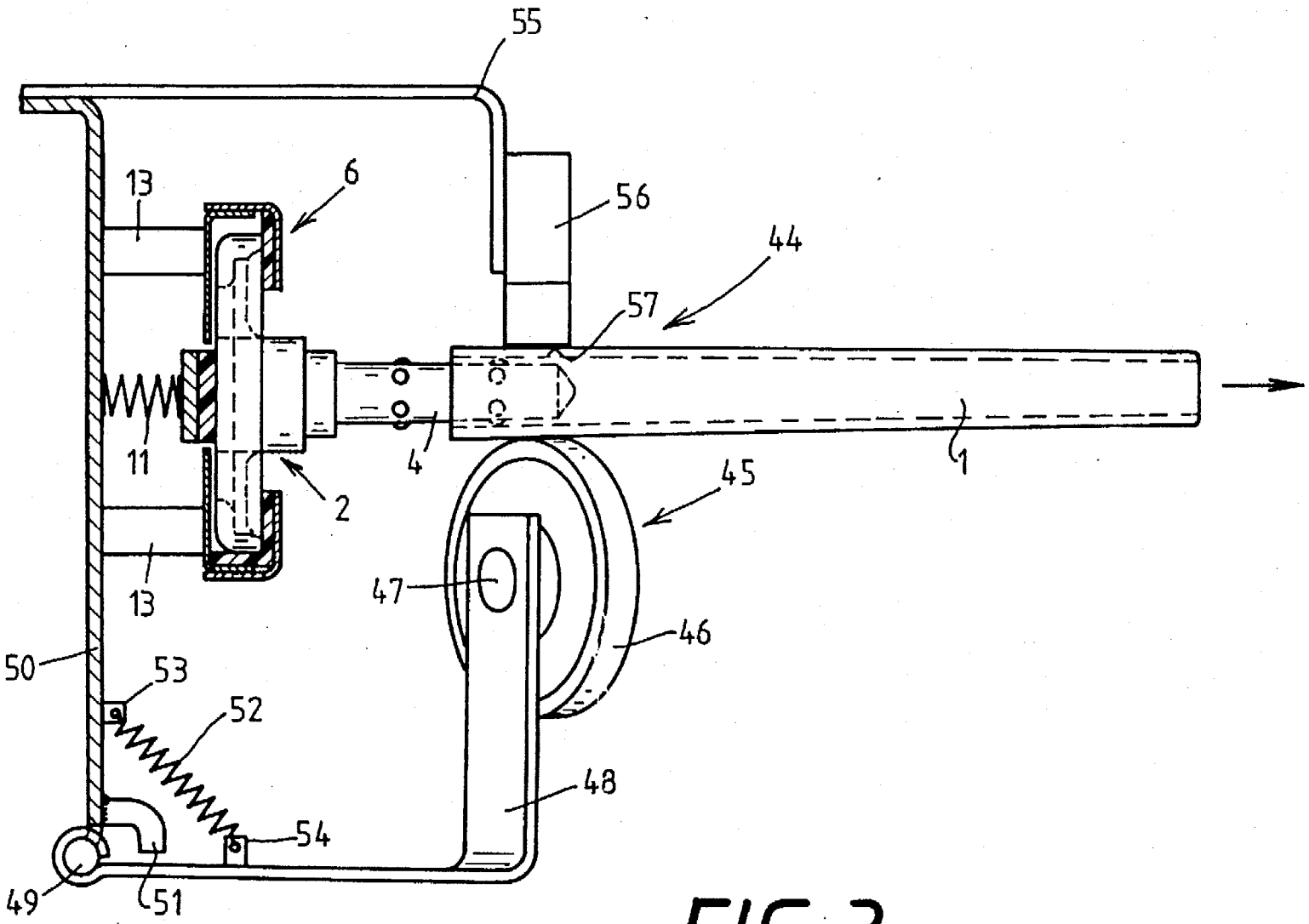
FIG. 3 is another end view partially in elevation and partially in section, similar to FIGS. 1 and 2, depicting a third alternative embodiment of the bobbin withdrawal apparatus of the present invention.

In a further variant of the invention represented in FIG. 3, a bobbin withdrawal apparatus 44 is equipped with only one rotatable disk 45 which is opposed by a pressure element 56 disposed at a spacing from the rotatable disk 45 along at least the corresponding lengthwise extent of the conveying path 6 along which there the bobbin 1 is in contact with the frictional coating 46 of the rotatable disk 45. The pressure element 56 is rigidly disposed on an angled arm 55 mounted to the machine frame 50, but has a smooth surface 57 facing the conveying path for contacting the bobbin 1 in order not to hamper the movement of the bobbin 1 either in the conveying direction or the withdrawal direction.

The rotatable disk 45 is attached via a shaft 47 to an angled sheet metal arm 48 which in turn is pivotable around a pivot shaft 49 connected with the machine frame 50. A stop 51 is disposed on the machine frame 50 to limit the pivotal movement of the angled sheet metal arm 48 in the direction toward the pressure element 56. The friction coating 46 of the rotatable disk 45 is kept in contact with the surface of the bobbin 1 during pivoting of the angled sheet metal arm 48 by means of a tension spring 52, which is suspended between holders 53, 54 in the machine frame 50 and the angled sheet metal arm 48.

As indicated, the pressure element 56 is rigidly connected with the machine frame 50 by means of a support arm 55. However, alternatively it would also be conceivable to embody this support elastically in such a way that it can be yieldable by a defined amount outwardly away from the disk 45. The same result could be achieved if the support 55 were pivotably connected with the machine frame 50 biased by a spring acting between the arm 55 and the machine frame 50.

In this embodiment, a conveyor belt biased by a pressure plate supported on a spring 11 is utilized as the conveying means, analogous with the example in FIG. 1. However, it should be understood that there is no particular relationship between the choice of the respective conveying means and the design of the respective withdrawal apparatus in any embodiment of the invention.

Figure 4:
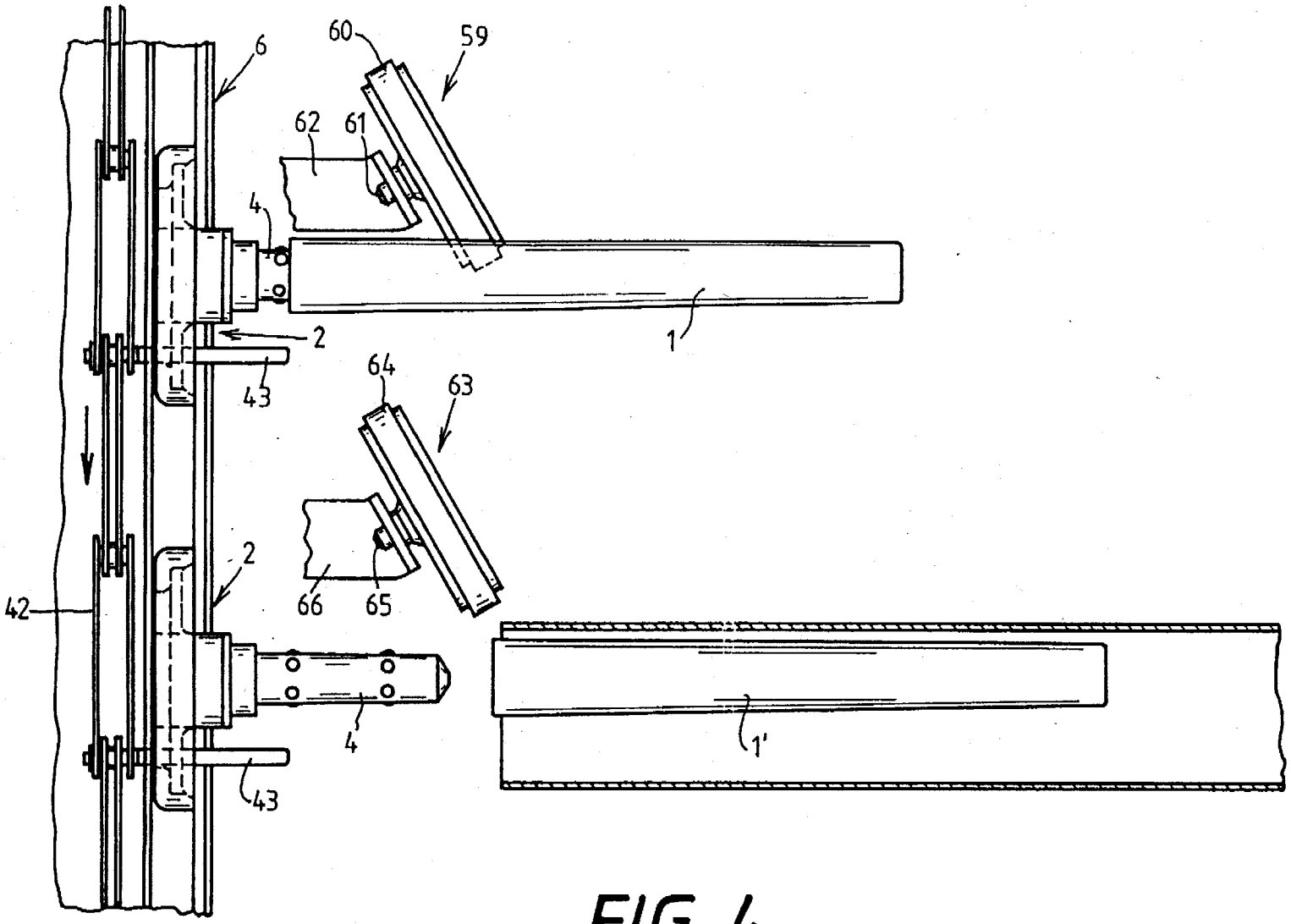
FIG. 4 is a side elevational view of a fourth embodiment of the present invention wherein two bobbin withdrawal apparatus are disposed in sequence with one other in the bobbin conveying direction, showing a section of the conveying path for the individual carriers adjacent the two bobbin withdrawal apparatus.

In FIG. 4, another embodiment of bobbin withdrawal apparatus 58 has been represented in a side elevational view lengthwise along the bobbin conveyance path 6. The bobbin withdrawal apparatus 58 comprises two withdrawal arrangements disposed at a spacing from one another along the conveying path, each having a pair of rotatable bobbin withdrawal disks essentially like that of FIGS. 1 and 2, of which only the one rotatable disk 59, 63 of each pair at the opposite side of the conveying path 6 has been shown. Each of these rotatable disks 59, 63 are provided with a frictional circumferential coating 60, 64 and are seated on shafts 61, 65 which in turn are fastened on angled sheet metal arms 62, 66 pivotably fastened and spring biased on the machine frame analogously to FIG. 1.

Such a withdrawal apparatus 58 is particularly advantageous if there are relatively long arbors 4 on the individual carriers 2 or if, because of a relatively high clamping force between the arbor 4 and the bobbin 1, the acceleration force between one pair of disks is not or may not be sufficient to axially accelerate the bobbin 1 sufficiently that a complete withdrawal of the bobbin is achieved by one disk pair. However, such a withdrawal apparatus 58 is also recommended if an orderly bobbin storage is to take place wherein the bobbins are intended to remain in their horizontal disposition to the greatest possible extent after leaving the withdrawal apparatus.

In the lateral view of FIG. 4, a bobbin and carrier conveying chain 42, such as that described above with respect to FIG. 2, can be seen more clearly, particularly as to the spacing along the chain 42 at which the dogs 43 are disposed. In this case, each of these dogs 43 extends through the base plate 3 of a respective individual carrier 2 in advance of the arbor 4 in the direction of the conveying path 6.

One bobbin, identified by 1', is depicted as already having been drawn off the arbor 4 of the associated carrier 2 and deposited into a collection apparatus, not indicated in detail, which can be formed by a conveyor belt, for example. The design of such a collection apparatus with an adjoiningly arranged bobbin storage location of the highest possible packing density can be seen in the German Patent Publication DE 40 38 628 A1, so that further description should not be necessary herein.

Figure 5:
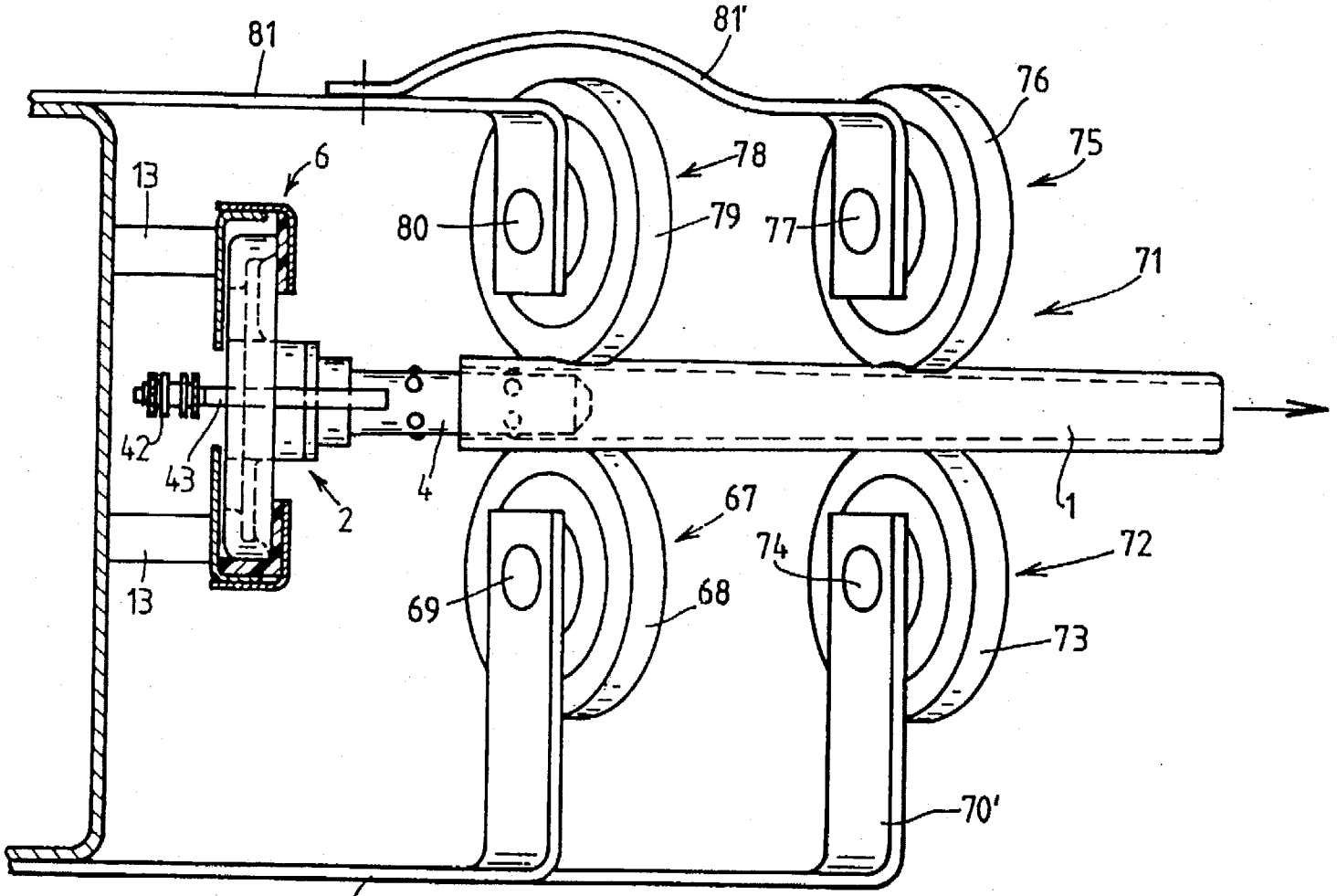
FIG. 5 is another end elevational view corresponding to FIGS. 1 to 3 showing a fifth embodiment of the present invention wherein two pairs of rollers are located at a spacing from each other along the longitudinal axis of the bobbin.

A further embodiment of the invention is represented in FIG. 5, wherein a bobbin withdrawal apparatus 71 is also constituted by two pairs of rollers 67, 78 and 72, 75. However, in contrast to the embodiment of FIG. 4, the two pairs of rollers 67, 78 and 72, 75 are not arranged at a spacing from one another along the conveying path of the bobbins 1, but rather are spaced from each other outwardly from the conveying path, i.e. spaced along the longitudinal axis of the bobbin.

All four rotatable disks 67, 72, 75, 78 are provided with a relatively thick elastic frictional coating 68, 73, 76, 79 about their respective circumferential peripheries whereby it is possible to do without a pivotable arrangement of the angled sheet metal supporting arms 70, 81. In addition, with pivotable support arms, the clamping gap between the outermost pair of rotatable disks 72, 75 would open wider than that between the rotatable disks 67, 78 during the passage of the bobbin 1, because of their greater distance from the pivot axis of the arms which necessarily would result in the clamping of the bobbin 1 between these rotatable disks 72, 75 being clearly reduced. In any event, because of the conically tapered shape of the bobbin 1, the clamping gap in the area of the outermost pair of rotatable disks 72, 75 must be narrower than that between the innermost pair of disks 67, 78. This can be achieved by the appropriately spacing the rotational shafts 74, 77 for the outer disks 72, 75 to be closer to each other than the disks 67, 78, or by providing the disks 72, 75 with an increased diameter in comparison to the disks 67, 78.

The rotatable disks 67, 78 are rotatably seated on shafts 69, 80 directly supported on the angled sheet metal arms 70, 81 which are rigidly affixed to the machine frame. The arms 70, 81 are extended by means of additional angled sheet metal arms 70', 81' which support the rotational shafts 74, 77 on which the rotatable disks 72, 75 are seated. The construction of the conveyor means and the conveying path it follows correspond to those described above in connection with FIGS. 2 and 4.

Also, it should normally be assumed that, with a bobbin withdrawal arrangement utilizing two pairs of rollers as in the embodiments of the invention represented in FIGS. 4 and 5, all combinations of bobbins 1 and individual carriers 2 or arbors 4 could be accommodated. It is also contemplated to be possible within the scope of the instant invention to realize a combination of these two embodiments. Even in such case, the withdrawal apparatus is still of a simplified design in contrast to the prior art, since no conveying means are required between the individual rotatable disks, and all pairs of rollers are exclusively driven by the movement of conveyed bobbins 1.

Figure 7:
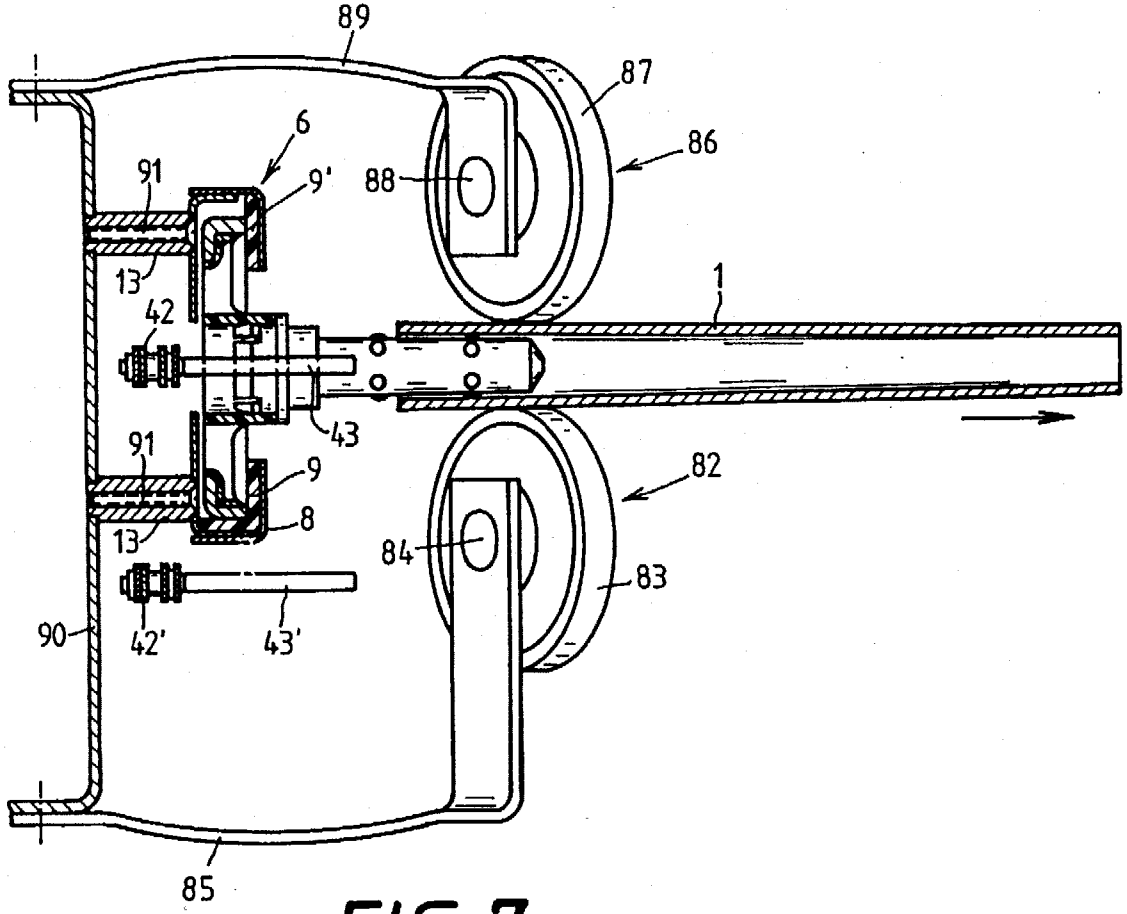
FIG. 7 is an end elevational view, partially in section, of the bobbin withdrawal apparatus in accordance with FIG. 6.
Figure 6:
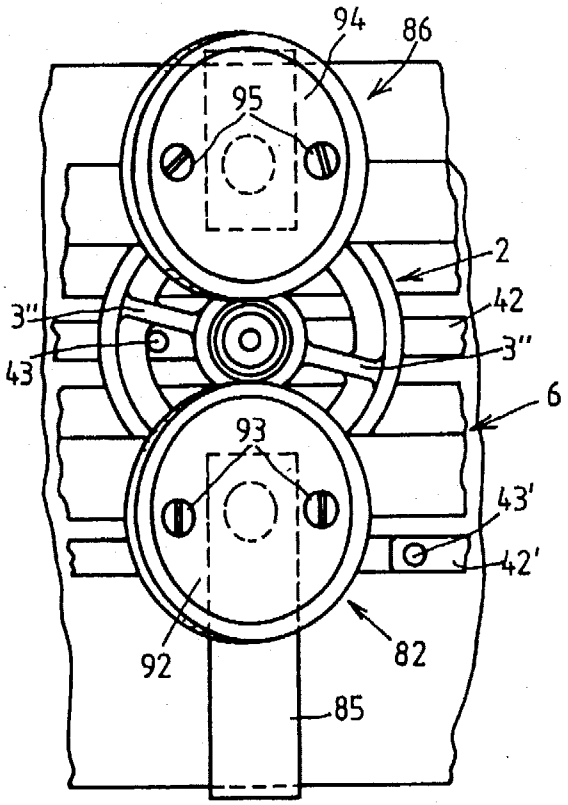
FIG. 6 is a top plan view of a sixth embodiment of a bobbin withdrawal apparatus of the present invention.

The embodiment of the invention represented in FIGS. 6 and 7 utilizes an interlocking chain-type conveying means corresponding to that shown in FIG. 4, for example, but otherwise differs from the embodiment shown in FIG. 1 only in that the angled sheet metal arms 85, 89 are not seated to the machine frame about a pivot shaft, but rather the arms 85, 89 themselves are sufficiently resiliently to yield, so that for all practical purposes the same clamping force effect results as with the first embodiment of FIG. 1. An advantageous design of the rotatable disks 82, 86 can be seen in the top view of FIG. 6, in that the frictional circumferential coating 83, 87 can be replaced as a wear component. Specifically, after the removal of a cover plate 92, 94 fastened by means of screws 93, 95 on the base body of the respective rotatable disk 82, 86, the frictional coating 83, 86 in the form of a ring is accessible and can be replaced. Accordingly, each rotatable disk 82, 86 is embodied as a ranged disk in which one rim thereof, I.e. the cover plate 92, 94, can be removed.

It can be further seen in the top view of FIG. 6, that the base plate 3 of the individual carrier 2 consists of an outer ring connected via spoke-like struts 3" with the center body of the base plate 3 whereby, as aforementioned, one dog 43 of the conveying chain 42 may engage one of the openings thusly defined between the struts 3" of the base plate 3.

An oppositely extending return run of the chain 42 is representatively indicated in FIGS. 6 and 7 by 42' and has dogs 43'. It can furthermore be seen that the supports 13 for the channel assembly 8 have bores into which screws 91 can be inserted, by means of which the channel assembly 8 can be fastened on the machine frame 90.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In an apparatus for conveying bobbin tubes along a conveying path while supported in upstanding disposition on individual tube carriers, an apparatus for removing bobbin tubes axially from the carriers, the bobbin removing apparatus comprising a pair of bobbin withdrawal means located at opposite lateral sides of the conveying path for frictionally engaging the bobbin tubes between the bobbin withdrawal means and for drawing the bobbin tubes off the respective carriers by the frictional engagement while the individual carriers are continuously conveyed along the conveying path, at least one of the withdrawal means comprising a freely rotatable disk having an annular periphery of a high coefficient of friction arranged for peripheral engagement with the bobbin tubes conveyed along the conveying path to be rotated by engagement with each bobbin conveyed past the disk, the disk being arranged to engage the bobbin tubes at an acute angle with respect to the conveying path of the individual carriers on which the tubes are supported.

2. An apparatus in accordance with claim 1, wherein the at least one withdrawal means comprises resilient means for biasing the disk.

3. An apparatus in accordance with claim 1, wherein the other withdrawal means located opposite the disk comprises a second freely rotatable disk arranged to be rotated by engagement with each bobbin tube conveyed past the second disk.

4. An apparatus in accordance with claim 3, wherein the second disk comprises an annular periphery of a high coefficient of friction arranged for peripheral engagement with the bobbin tubes conveyed along the conveying path.

5. An apparatus in accordance with claim 3, wherein the axis of rotation of the second disk is disposed at an offset in respect to the axis of rotation of the first disk along the conveying path of the bobbin tubes.

6. An apparatus in accordance with claim 3, wherein the annular periphery of each disk comprises an elastically deformable material disposed relative to the conveying path to be deformed when contacting bobbin tubes conveyed along the conveying path.

7. An apparatus in accordance with claim 1, wherein the other withdrawal means comprises a pressure element having a bobbin tube engaging surface of a low coefficient of friction to promote sliding of the bobbin tubes therealong.

8. An apparatus in accordance with claim 1, wherein the other withdrawal means comprises resilient means for biasing toward the conveying path.

9. An apparatus in accordance with claim 1, wherein two pairs of the withdrawal means are arranged at a spacing to one another along the conveying path.

10. An apparatus in accordance with claim 1, wherein two pairs of the withdrawal means are disposed adjacent the conveying path at a spacing from one another axially relative the longitudinal of the bobbins.

11. An apparatus in accordance with claim 1, wherein the conveying path at the withdrawal means is oriented to dispose the bobbins being conveyed thereat in an essentially horizontal disposition.

12. An apparatus in accordance with claim 1, wherein the conveying apparatus comprises elements spaced along the conveying path for interlocking contact with the individual carriers.

13. An apparatus in accordance with claim 1, wherein the conveying apparatus is arranged for frictional contact with the individual carriers and, at least at the withdrawal means, comprises means for applying an additional force urging frictional contact with the individual carriers.

14. An apparatus in accordance with claim 1, wherein a bobbin collecting apparatus is disposed underneath the withdrawal means.

* * * * *